US005565900A

United States Patent [19]

Cowger et al.

[11] Patent Number: 5,565,900

[45] Date of Patent: Oct. 15, 1996

[54] UNIT PRINT HEAD ASSEMBLY FOR INK-JET PRINTING

[75] Inventors: Bruce Cowger; Donald B. Ouchida; Robert R. Beeson, all of Corvallis, Oreg.

[73] Assignee: Hewlett-Packard Company, Palo Alto, Calif.

[21] Appl. No.: 192,087

[22] Filed: Feb. 4, 1994

[51] Int. Cl.[6] ..... B41J 2/155

[52] U.S. Cl. ..... 347/42

[58] Field of Search ..... 347/42, 49, 50, 347/86, 87

[56] References Cited

U.S. PATENT DOCUMENTS

| | | | |
|---|---|---|---|
| 4,368,478 | 1/1983 | Koto | 347/86 |
| 4,394,669 | 7/1983 | Ozawa et al. | 347/86 |
| 4,433,341 | 2/1984 | Thomas | 347/6 |
| 4,462,037 | 7/1984 | Bangs et al. | 347/85 |
| 4,475,116 | 10/1984 | Sicking et al. | 347/86 |
| 4,500,895 | 2/1985 | Buck et al. | 347/87 |
| 4,510,510 | 4/1985 | Terasawa | 347/30 |
| 4,577,200 | 3/1986 | Rix et al. | 347/49 |
| 4,614,948 | 9/1986 | Katerberg et al. | 347/89 |
| 4,620,202 | 10/1986 | Koto et al. | 347/87 |
| 4,628,332 | 12/1986 | Matsumoto | 347/49 |
| 4,633,274 | 12/1986 | Matsuda | 347/50 |
| 4,635,073 | 1/1987 | Hanson | 347/50 |
| 4,680,859 | 7/1987 | Johnson | 29/611 |
| 4,683,481 | 7/1987 | Johnson | 347/65 |
| 4,694,308 | 9/1987 | Chan et al. | 347/65 |
| 4,712,172 | 12/1987 | Kiyohara et al. | 347/60 |
| 4,746,935 | 5/1988 | Allen | 347/98 |
| 4,771,295 | 9/1988 | Baker et al. | 347/87 |
| 4,791,438 | 12/1988 | Hanson et al. | 347/87 |
| 4,806,106 | 2/1989 | Mebane et al. | 439/77 |
| 4,814,786 | 3/1989 | Hoisington et al. | 347/88 |
| 4,847,630 | 7/1989 | Bhaskar et al. | 347/63 |
| 4,872,026 | 10/1989 | Rasmussen et al. | 347/56 |
| 4,872,027 | 10/1989 | Buskirk et al. | 347/19 |
| 4,917,286 | 4/1990 | Pollacek | 228/110.1 |
| 4,929,969 | 5/1990 | Morris | 347/87 |
| 4,940,413 | 7/1990 | Childers et al. | 439/67 |
| 4,953,287 | 9/1990 | West et al. | 29/611 |
| 5,016,023 | 5/1991 | Chan et al. | 347/42 |
| 5,049,904 | 9/1991 | Nakamura et al. | 347/19 |
| 5,091,737 | 2/1992 | Toganoh et al. | 347/42 |
| 5,448,274 | 9/1995 | Hirabayashi et al. | 347/50 |
| 5,469,199 | 11/1995 | Allen et al. | 347/42 |

FOREIGN PATENT DOCUMENTS

0376719A3 7/1990 European Pat. Off. .

OTHER PUBLICATIONS

"Printhead Interconnect," R. T. Buck; HP Journal, May 1985.

*Primary Examiner*—Benjamin R. Fuller
*Assistant Examiner*—Craig A. Hallacher

[57] ABSTRACT

Ink-jet pens having multiple print heads are manufactured with readily replaceable unit print head assemblies that facilitate testing of print head performance prior to complete assembly of the pen.

10 Claims, 5 Drawing Sheets

UNIT PRINT HEAD ASSEMBLY FOR INK-JET PRINTING

TECHNICAL FIELD

This invention pertains to ink-jet printing, and in particular to modular-type manufacture of ink-jet printing pens, whereby a print head assembly is constructed as a unit and thereafter removably mounted to the pen body.

BACKGROUND AND SUMMARY OF THE INVENTION

Some ink-jet printers, such as manufactured by Hewlett-Packard Company under the designation DeskJet, include a cartridge or "pen" that is mounted to a carriage in the printer. The pen includes a body that defines a reservoir of ink, and a print head that is operated for ejecting minute ink drops onto paper that is advanced through the printer.

Prior ink-jet pens have been constructed so that the print head is irremovably attached to the pen body, thereby preventing replacement of a print head without damage to the pen.

Some ink-jet printer pens can be designed to include more than one print head. For example, a pen can be constructed to include a plurality of print heads that span across the entire width of a page that is advanced through the printer.

In the event that such a multiple-print-head pen were manufactured using conventional techniques, the entire pen would have to be assembled before the printing characteristics of the print heads could be tested. A failure of one of the print heads, therefore, would ruin the entire pen and lead to expensive waste or re-work for repairing the pen.

The present invention is directed to a construction whereby ink-jet printer pens have modular or unit print head assemblies that can be readily mounted to and removed from a pen body in the event that the assembly needs repair or replacement. Moreover, the print heads of an individual unit print head assembly may be fully tested before that assembly is joined with several other parts in manufacturing a pen.

DETAILED DESCRIPTION OF A PREFERRED EMBODIMENT

Figure 1:
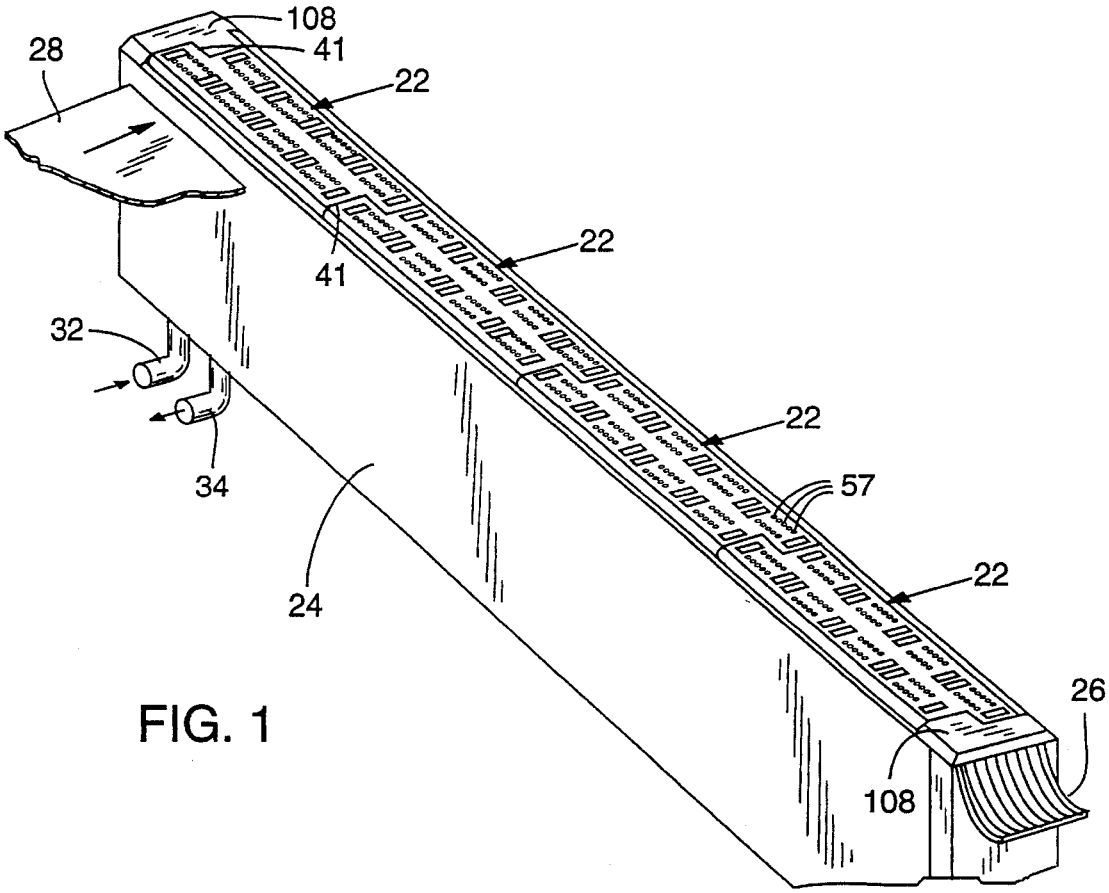
FIG. 1 is a perspective view of an ink-jet pen employing several unit print head assemblies made in accordance with the present invention.
Figure 4:
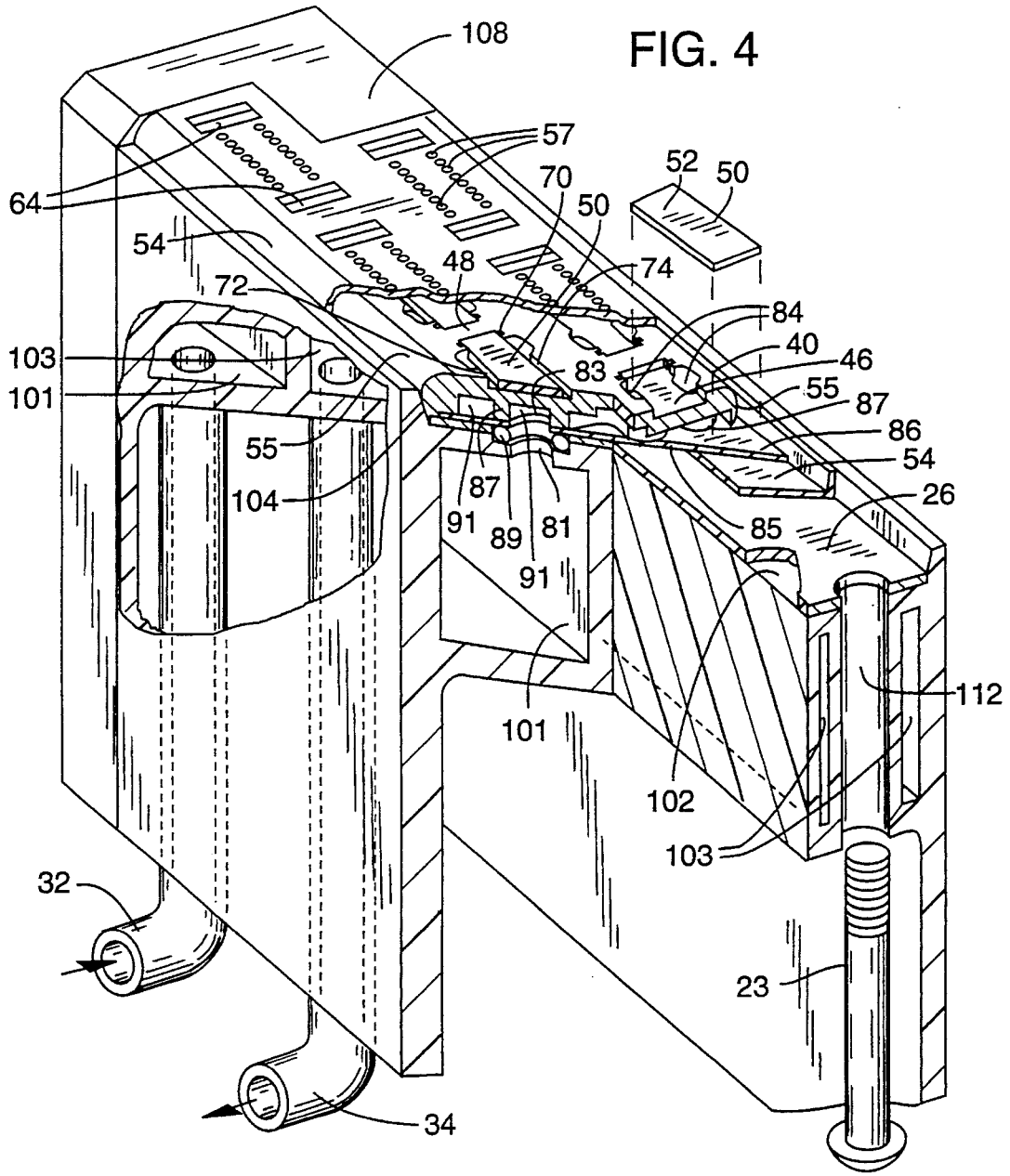
FIG. 4 is a perspective view, partly cut away, showing an assembled ink-jet pen that incorporates unit print head assemblies.

FIG. 1 depicts a pen 20 for use with an inkjet printer. The pen 20 includes a plurality of unit print head assemblies 22 (hereafter occasionally referred to as "assemblies," for convenience) constructed in accordance with the present invention. The pen 20 includes a substantially rigid body 24 to which the assemblies 22 are removably mounted as explained more fully below. In one embodiment, for example, the assemblies 22 are mounted to the pen body by threaded fasteners 23 (FIG. 4).

The pen body 24 can be mounted to a printer by any of a number of means in association with conventional mechanisms for advancing paper 28 immediately adjacent to the assemblies 22 so that ink drops can be ejected onto the paper from print heads carried by the assemblies. The pen body 24 includes a ribbon-type multiconductor 26 for conveying control signals to the assemblies, as described more fully below.

When the assemblies 22 are mounted to the pen body 24 they are placed in fluid communication with a supply of ink. As shown in FIG. 1, the ink supply may be conducted to the pen body 24 from a remote source via an inlet conduit 32. The pen body 24 is constructed to define a manifold for conducting and distributing supply ink to each of the assemblies 22. In a preferred embodiment, supply ink that is not expelled by the print heads during printing is removed from the manifold and circulated back to the supply via outlet conduit 34.

With reference to FIGS. 2–5, the particulars of a unit print head assembly 22 and the pen body 24 to which it is mountable will now be described.

A print head assembly 22 includes a carrier 40 made of molded plastic. Alternatively, ceramic, die-cast metal, or machined metal may be used. The carrier 40 carries print heads 50 (FIG. 4). In this regard, a number (for example, eight) of oblong recesses 46 are formed in a top, planar surface 48 of the carrier 40. A print head 50 that generally corresponds to the shape of a recess 46 fits within the recess and is mounted thereto, such as by bonding with adhesives.

In a preferred embodiment, each carrier 40 includes two rows of print heads 50, with one row of print heads offset relative to the other row of print heads so that, in the direction of paper movement (FIG. 1), there are no gaps between the nozzles 57 of the print heads in one row and the nozzles of print heads in the other row. This offset relationship defines a 90° notch at each end 41 of the carrier.

The outer surface 52 of the print head 50 and the surface 48 of the carrier 40 are covered with a flexible circuit 54 that also wraps around the rounded long edges 55 of the carrier. The circuit 54 also extends over part of the carrier bottom plate 85 (FIG. 3), as described more fully below.

The flexible circuit 54 may be staked to the carrier 40. Specifically, the circuit is applied to the exterior surface of the carrier under pressure and heat sufficient for causing plastic flow of the plastic carrier so that the underside of the flexible circuit 54 is joined to the carrier.

Figure 7:
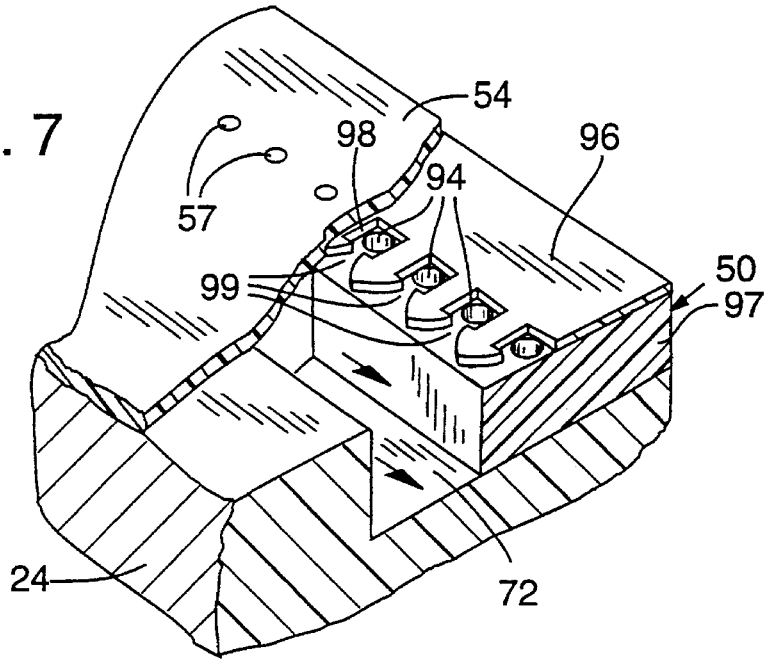
FIG. 7 is an enlarged detail view, partly in section, showing a portion of a print head that is carried by the unit print head assembly.

The part of the circuit 54 that covers the upper surface 52 of each print head 50 has defined through it two rows of minute nozzles 57. Each individual nozzle is in fluid communication with a firing chamber 98 in the print head (FIG. 7). Each firing chamber 98 has associated with it a thin-film resistor 94 that is selectively driven (heated) with sufficient current for instantaneously vaporizing some of the ink that enters the chamber, thereby forcing a drop of ink through the nozzle.

Figure 3:
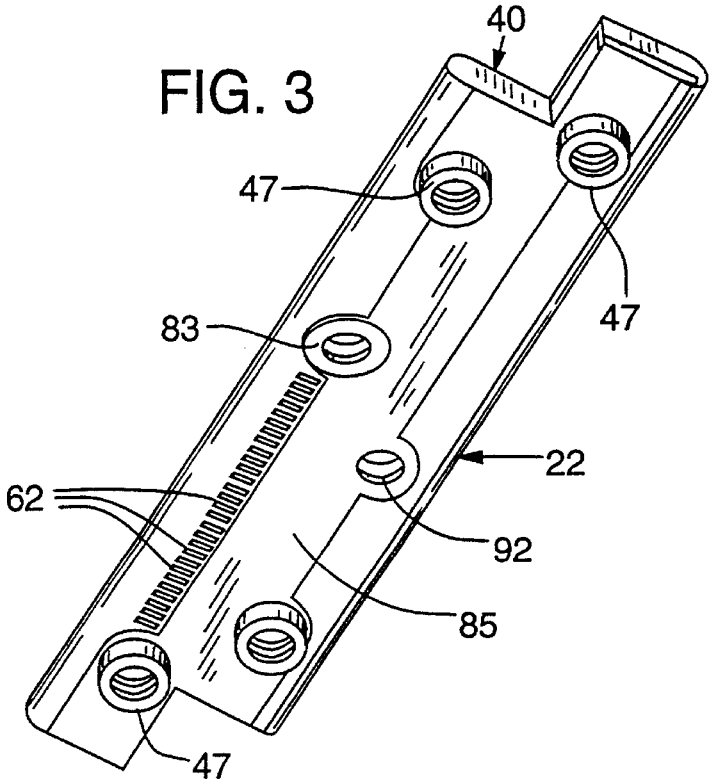
FIG. 3 is a perspective view showing the bottom of a unit print head assembly.

In a preferred embodiment, the flexible circuit 54 comprises a strip of polyimide, the underside of which (that is, the side of the strip that is staked to the carrier 40) has bonded to it a multitude of copper traces (not shown), each trace being joined at one end to an embossed, conductive contact pad 62 (FIG. 3). The contact pads are exposed on the exterior surface of the circuit 54 on the underside of the print head assembly 22. The contact pads connect with corresponding contacts mounted on the pen bodies as described more fully below.

The other ends of the traces on the circuit terminate in free ends or beams that are welded to corresponding conductors carried on the print head 50. In this regard, windows 64 are provided through the flexible circuit 54. The beams of the traces protrude into the windows and are exposed there for welding to the conductors on the print head. A method and associated apparatus for attaching a flexible circuit to a pen body and print head is described in U.S. patent application Ser. No. 07/737,623, owned by the assignee of the present application and herein incorporated by reference.

With particular reference to FIG. 4, each recess 46 in the carrier 40 is constructed to be generally wider than the print head 50 received therein, except at the ends of the recess, where opposing alignment features 70 protrude inwardly toward the longitudinal center line of the recess. The distance between the pair of alignment features 70 at each end of the recess substantially matches the width of the print head 50. As a result, these features secure the print head with its longitudinal center line matching that of the recess.

The long side edges of the print head 50 are spaced from the corresponding long side edges of each recess 46. This spaced relationship, therefore, defines an elongated first ink passageway 72 extending the substantial length of one side of the print head 50, and a corresponding second ink passageway 74, extending along the substantial length of the other side of the print head (FIG. 4). It will be appreciated that with the flexible circuit 54 in place, the passageways 72, 74 are substantially enclosed along their length by the print head 50, carrier 40, and the underside of the circuit 54.

Figure 5:
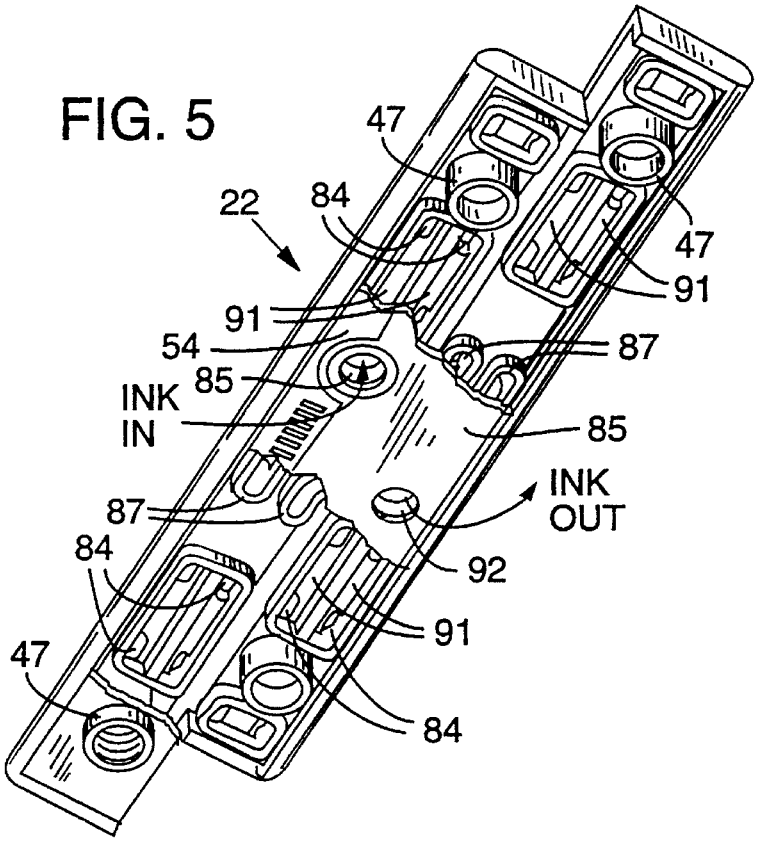
FIG. 5 is a bottom view similar to FIG. 3 but showing the assembly with part of the bottom plate cut away.

At the end of each passageway 72, 74, there is formed through the carrier a via 84 (FIGS. 4 and 5). The viae 84 conduct the flow of ink in the associated ink passageway 72 or 74 between that passageway and a corresponding one of a series of ducts 91 that are defined by the underside of the carrier 40 and the bottom plate 85. In particular, the underside of the carrier 40 is formed to include downwardly protruding ribs 87, best shown in FIG. 5. The lowermost edges of the ribs are in a common plane so that the ribs evenly rest on the upper surface 86 (FIG. 4) of the bottom plate 85. The bottom plate 85 may be formed of any suitably rigid material, such as molded plastic.

Figure 6:
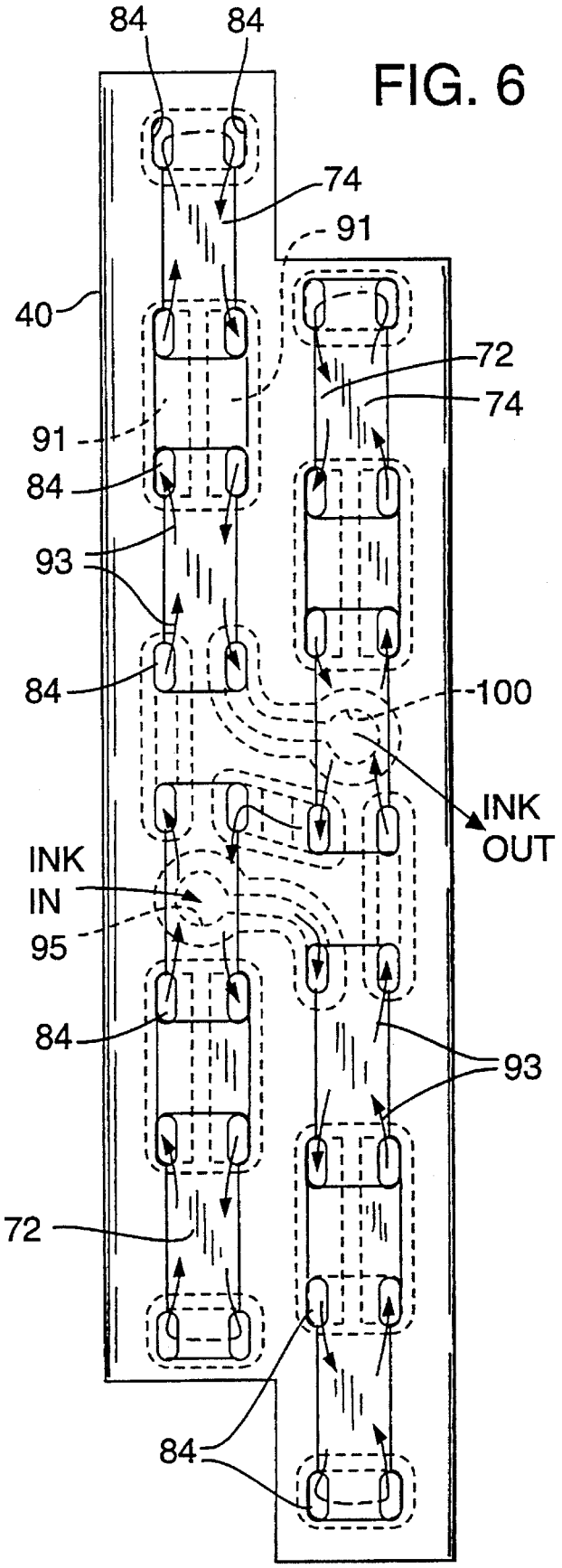
FIG. 6 is a top plan view diagram illustrating an ink circulation path through the unit print head assembly of the present invention.

The downwardly protruding ribs 87 define in combination with the surface 86 of the bottom plate the ducts 91 that connect certain viae 84 and the recesses 46 so that ink flows through passageways 72, 74 over a continuous path from print head to print head. The top view, simplified (print heads omitted) diagram of a carrier, FIG. 6, shows by arrows 93 the continuous path of ink through the ducts 91, passageways 72, 74, and viae 84.

The carrier 40 also has protruding from its underside a set of annular, spaced-apart bosses 47 that protrude from the bottom plate 85. The bosses 47 provide a mechanism for mounting the print head assembly to the pen body, as described more fully below.

Two ports 83, 92 (FIG. 3) are formed in the bottom plate 85. One port 83 aligns with a rounded end 95 (FIG. 6) of a duct 91 in the carrier and, therefore, forms an inlet to permit ink to enter the series of connected ducts 91, viae 84 and passageways 72, 74. The port 83 aligns with and seals in fluid communication with a manifold aperture 81 formed in the pen body 24 in communication with an inlet manifold 101 that is filled with ink via supply conduit 32 (FIG. 4).

The inlet manifold 101 is defined by the pen body 24 as an elongated conduit or chamber extending along the length of the pen body 24. An aperture 81 is formed in the pen body at the inlet port 83 of each assembly that is mounted to the pen body. Preferably, an elastomeric 0-ring 89 is secured in a countersunk portion of each manifold aperture 81 to be compressed between the body and the carrier to provide a tight seal therebetween.

Similarly, outlet port 92 aligns with the rounded end 100 of the last in the series of ducts 91. The outlet port 92 seals in fluid communication with another aperture on the pen body (not shown) for directing ink that flows out of that port 92 into an outlet manifold 103. The outlet manifold 103 collects ink from each outlet port 92. Ink is removed from manifold 103 via conduit 34.

FIG. 7 depicts in greatly enlarged detail the relationship between print head firing chambers 98 and the first ink passageway 72. Specifically, the print head 50 may be constructed to include a substrate layer 97 that carries on it a number of thin-film resistors 94, one resistor underlying a corresponding nozzle 57 in the flexible circuit 54. Each resistor 94 is electrically connected with a discrete conductive member (not shown) that is connected with a corresponding end of a copper trace carried by the flexible circuit as mentioned above.

A thin, barrier layer 96 of polymeric material covers the substrate and is shaped by, for example, a photolithographic process to define the small-volume firing chambers 98 that surround each resistor 94. The outermost edges of the barrier 96 are shaped to define for each chamber 98 an entry region 99 through which ink may flow into the firing chamber. A portion of the ink is vaporized by the resistor, the resultant fluid expansion in the chamber ejecting a drop of ink through the corresponding nozzle 57 onto passing paper 28.

As can be seen upon review of FIG. 7, the first ink passageway 72 is oriented to be in fluid communication with the print head so that ink is continuously flowing immediately adjacent the entry regions 99 of each firing chamber.

The print head construction is generally symmetrical about the longitudinal center line of the print head 50. Accordingly, it will be appreciated that the relationship of a second ink passageway 74 and the print head firing chambers on the opposing side of the print head provide the same ink flow across the firing chambers 98 as that of the first ink passageway 72.

Although the print head and ink circulation system just described may be a preferred embodiment, it is contemplated that print heads having firing chamber entrances fed from a channel in the center, underside of the print head may also be used with a carrier of the present invention. The ink passageways of the carrier would be shaped to flow to central channels. Moreover, the print heads used with the present invention need not be supplied with circulating ink.

Figure 2:
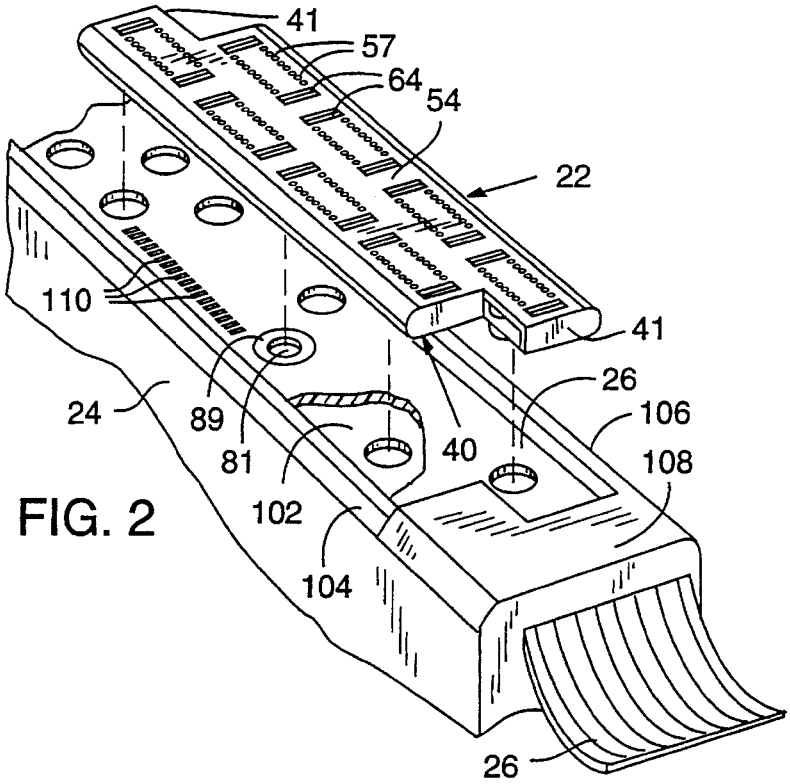
FIG. 2 is an enlarged, exploded view showing a unit print head assembly and part of the pen body to which the assembly is mounted.

Turning now to the particulars of the pen body portion to which the assemblies 22 are mounted, with reference to FIGS. 2 and 4, the pen body includes a mounting location that comprises a recessed, planar surface 102 defined between opposing, upwardly protuding lips 104, 106 that extend along the length of the pen body. Each short edge of the pen body includes a generally L-shaped end piece 108 that is shaped to conform to the notched end of the print head assembly 22, as best shown in FIG. 4.

The above-mentioned ribbon-type multiconductor 26 is attached to the surface 102 and includes clearance holes formed therethrough so as not to block the assembly bosses 94 or inlet and outlet ports 83, 92. At locations underlying the embossed contact members 62 on the print head assembly underside (see FIG. 3), the multiconductor 26 carries embossed contacts 110 at the termini of the conductors formed in the multiconductor 26.

Whenever the print head assembly is mounted to the pen body, therefore, the embossed contacts 62 on the assembly 22 press against, and, hence, electrically connect with the aligned embossed contacts 110 on the multiconductor 26. As a result, there is defined a continuous conductive path for conducting electronic control signals between the contacts 110 and the circuit member conductors, the control signals being provided by the printer controller for firing the resistors 94 as mentioned above.

As mentioned above, threaded fasteners 23 may be employed for removably mounting a print head assembly 22 to a pen body 24. In this regard, the pen body may be formed to include a sleeve 112 (FIG. 4) through which a threaded fastener may extend. The threaded end of the fastener 23 extends into the sleeve to engage an internally threaded boss 47 of an assembly, which boss fits through a clearance hole in the multiconductor 26 and protrudes into the bore of the sleeve 112. The fastener 23 is sized so that when threaded tightly into the boss 47 the assembly is held firmly against the pen body. It will be appreciated that although only one fastener is shown in FIG. 4 there is provided a fastener and sleeve for each of the four threaded bosses 47 of each assembly 22.

Figure 8:
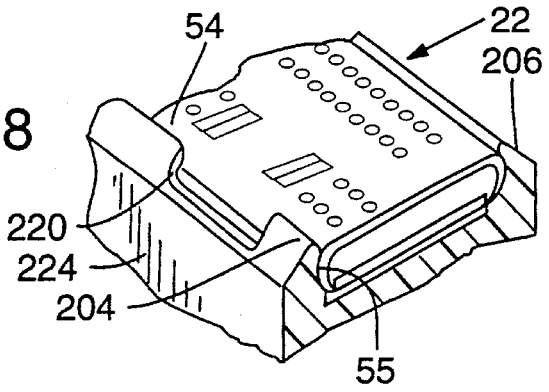
FIG. 8 is a detail view of an alternative mechanism for mounting a print head assembly to a pen.

Numerous alternative mechanisms may be employed for mounting a print head assembly to a pen body. For example, as shown in FIG. 8, a print head assembly 22 may be snap-fit into a pen body 224 that has protruding lips 204, 206 shaped to generally conform to the rounded long edges 55 of the carrier. Accordingly, the assembly 22 is pressed between the lips, which yield slightly to permit the widest portion of the assembly to pass between the narrowest portion of the lips. The pen body lips thereafter resile to firmly hold the assembly in place against the pen body 224.

Notches 220 are formed in spaced-apart locations along the length of one of the lips 204 to permit a thin flat lever to fit through the notch and part way under the assembly, thereby to pry the assembly 22 from the pen body 224.

It will be appreciated by one of ordinary skill in the art that a testing device conforming to a pen body (24 or 224) for holding a single print head assembly 22 can be constructed for testing individual assemblies 22 before they are joined with several other assemblies to make a complete pen.

Figure 9:
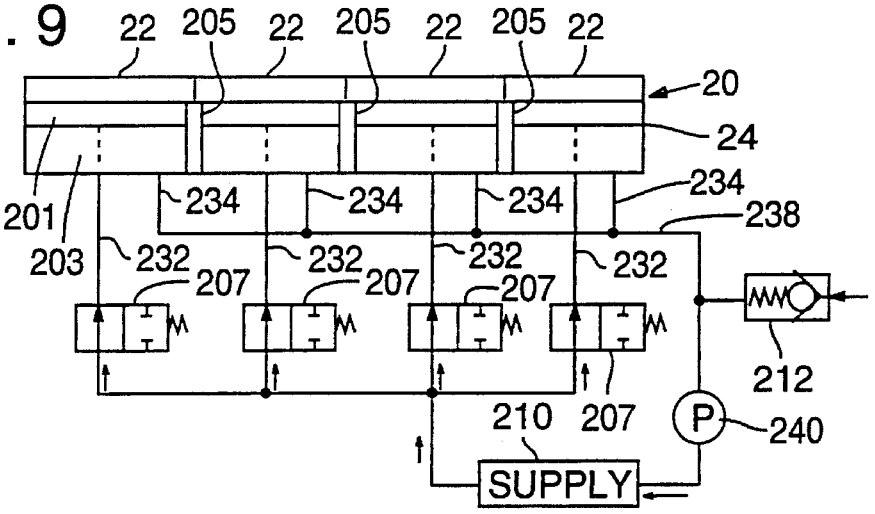
FIG. 9 is a diagram showing one system for delivering a circulating ink supply to the unit print head assemblies of the pen.

Any of a number of systems may be employed for supplying circulating ink to a print head assembly via conduits 32, 34. One preferred supply system is shown in FIG. 9. In this embodiment, the pen body 24 includes internal partitions 205 that define a discrete inlet and outlet manifold pair underlying each assembly 22. In this regard, the embodiment of FIG. 9 is different from the embodiment described above in that the earlier-described embodiment includes a single manifold pair 201, 203 that extends across a substantial length of the pen body across all of the print head assemblies 22.

As shown in FIG. 9, each inlet manifold 201 receives ink from a connected supply conduit 232. An outlet manifold discharges ink through an outlet conduit 234. Ink is supplied to each supply conduit 232 from a supply 210 that comprises any container suitable for storing a supply of ink. The outlet conduits 234 are tied to a return line 238 to which is connected a diaphragm pump 240 that provides a pressure gradient for generating the ink flow through the system in a circulating manner as depicted.

In a preferred embodiment, the fluid pressure within the system is maintained slightly below ambient so that ink will not leak from the print head nozzles 57 when the firing chambers are inactive. It is desirable, however, to regulate the pressure within the system so that the partial vacuum or back pressure established in the system does not become so high as to prevent the drop ejection forces generated in the firing chambers from overcoming the back pressure. To this end, a vacuum regulator 212 is connected to the return line 238 (or to any other location in the system) to permit the limited entry of ambient air into the system in the event that pressure within the system drops below a predetermined threshold level. Preferably, the vacuum regulator 212 is adjustable for changing the threshold level as necessary.

Interconnected between the supply container 210 and each inlet conduit 232 is a normally closed valve 207. The valves may be any suitable electronically controlled valves that are normally closed when the printer is not operating. The closed valves, therefore, tend to maintain the partial vacuum or back pressure within the associated print head assembly 22 even if the pen 20 is tipped out of its normal position, which tipping would impart a pressure head in the assembly tending to cause the lower nozzles to leak and the upper nozzles to become de-primed. In a preferred embodiment, the length of a print head assembly from one end 41 to another (that is, the length of a continuous passageway filled with ink) is less than the back pressure (measured in inches of water column) to be maintained in the print head assembly so that in instances where one end of the pen is tipped directly above the other end of the pen, the resultant pressure head in an individual assembly will not exceed the back pressure maintained within the assembly by the closed valve.

It is contemplated that the above-described manifolds are not required and that inlet conduits 32, 232 can be directly connected to the inlet ports 83 of each assembly 22, and the outlet conduits 34, 234 may be similarly connected directly to outlet ports 92 of the assemblies.

Although the foregoing invention has been described in connection with preferred and alternative embodiments, it will be appreciated by one of ordinary skill that various modifications and variations may be substituted for the mechanisms and method described here without departing from the invention as defined by the appended claims and their equivalents.

For example, a preferred embodiment described above is illustrated in FIG. 2 with four carriers, each carrier being sized to carry eight print heads. It is contemplated, however, that the carrier and pen body configuration is readily adaptable to more or fewer carriers that carry one or any number of print heads.

The invention claimed is:

1. A pen for an ink-jet printer, comprising:

a print head assembly, including:

a carrier having an outer side and an inner side;

at least one print head mounted to the carrier, the print head having a plurality of chambers defined therein, the print head also having firing means associated with each chamber for expelling ink drops from the chambers;

the carrier defining a passageway in fluid communication with the chambers, the passageway including an inlet port extending through the inner side and through which port ink may flow into the passageway to the chambers;

a circuit member attached to the carrier and having conductors for conducting control signals to the firing means, the firing means responsive to the control signals for expelling ink drops from the chambers;

a pen body having a mounting surface including:

electrical contacts mounted to the pen body;

a conduit defined by the pen body for conducting ink through the conduit, the conduit including an aperture through the mounting surface; and mounting means for removably mounting the carrier inner side adjacent to the pen body mounting surface so that the conductors and the contacts join to form a junction to provide continuous paths for conducting control signals between the contacts and the circuit member conductors and so that the aperture and inlet port join to form a junction and are in fluid communication.

2. The pen of claim 1 comprising more than one print head assembly as defined in claim 1, and wherein the mounting means is for removably mounting more than one print head assembly to the pen body so that the conductor and the contacts join to provide continuous paths for conducting control signals between the contacts and the conductors, and so that the conduit and inlet ports are joined in fluid communication.

3. The pen of claim 1 wherein the mounting means comprises removable fasteners connected between the carrier and pen body for removal of the mounted print head assembly without damage to the pen body.

4. The pen of claim 1 wherein the mounting means includes:

resilient snap members protruding from the pen body to force together the circuit member conductors and the pen body contacts so that the junction between the conductors and the contacts is made.

5. The pen of claim 1 wherein the carrier includes an outlet port through which ink that flows into the passageway may flow out of the passageway.

6. The pen of claim 1 further comprising a seal member attached between the carrier and pen body for sealing the joined aperture and inlet port.

7. The pen of claim 1 further comprising:

a mounting portion defined by the pen body and to which is mounted a plurality of carriers;

ink delivery means for supplying ink from a supply to all carriers that are mounted to the pen body, the ink delivery means including conduits connected between the supply and each carrier; and a valve connected to each conduit, each valve being operable for opening and closing the conduit.

8. A method of making a pen for an ink-jet printer, comprising the steps of:

providing a carrier having at least one print head mounted thereto wherein the print head has a plurality of chambers defined therein for receiving ink, the print head also having firing means associated with each chamber for expelling ink drops from the chambers;

defining in the carrier a passageway to be in fluid communication with the chambers, the passageway including an inlet port through which ink may flow into the passageway to the chambers;

attaching a circuit member to the carrier, the circuit member having conductors for conducting control signals to the firing means, the firing means responsive to the control signals for expelling ink drops from the chambers, the conductors terminating in a plurality of contact members;

providing a pen body that has exposed electrical contacts mounted thereto and a conduit defined by the pen body for conducting ink from a supply through the conduit; and removably mounting the carrier to the pen body so that the contact members and the electrical contacts are pressed together to provide continuous paths for conducting control signals between the electrical contacts and the conductors, and so that the conduit and inlet port are joined to form a junction and are in fluid communication.

9. The method of claim 8 wherein the attaching step includes attaching the circuit member so that the contact members are exposed for pressure connection with the electrical contacts on the pen body when the carrier is mounted to the pen body.

10. The method of claim 8 including the step of providing a seal member for sealing the junction of the conduit and inlet port.

* * * * *